US008413910B2

(12) United States Patent
Bösterling et al.

(10) Patent No.: US 8,413,910 B2
(45) Date of Patent: Apr. 9, 2013

(54) BASE PLATE FOR FASTENING A RAIL TO A FIXED BOTTOM SUPPORT, AND FASTENER FOR A RAIL

(75) Inventors: Winfried Bösterling, Neuenrade (DE); Lutz Rademacher, Lüdenscheid (DE); Adrian Bednarczyk, Lüdenscheid (DE); André Hunold, Iserlohn (DE)

(73) Assignee: Vossloh-Werke GmbH, Werdohl (DE)

( * ) Notice: Subject to any disclaimer, the term of this patent is extended or adjusted under 35 U.S.C. 154(b) by 54 days.

(21) Appl. No.: 12/607,623

(22) Filed: Oct. 28, 2009

(65) Prior Publication Data

US 2011/0068182 A1 Mar. 24, 2011

(30) Foreign Application Priority Data

Sep. 18, 2009 (DE) ..... 10 2009 041 833

(51) Int. Cl.
*E01B 9/38* (2006.01)
*E01B 9/62* (2006.01)
*E01B 9/66* (2006.01)

(52) U.S. Cl.
USPC ..... 238/264; 238/283; 238/306; 238/307; 238/338

(58) Field of Classification Search ..... 238/152, 238/264, 280, 282, 283, 287, 290, 306, 307, 238/310, 338
See application file for complete search history.

(56) References Cited

U.S. PATENT DOCUMENTS

| | | | | |
|---|---|---|---|---|
| 5,735,457 | A * | 4/1998 | Bohm et al. | 238/283 |
| 6,318,026 | B1 * | 11/2001 | Ayres et al. | 49/503 |
| 7,080,791 | B2 * | 7/2006 | Geissele et al. | 238/264 |
| 2007/0001020 | A1 * | 1/2007 | Schonstein | 238/306 |
| 2008/0179419 | A1 | 7/2008 | Vives Clavel | |
| 2011/0068183 | A1 * | 3/2011 | Bednarczyk | 238/264 |
| 2011/0068184 | A1 * | 3/2011 | Rademacher et al. | 238/282 |
| 2011/0068185 | A1 * | 3/2011 | Bosterling et al. | 238/283 |

FOREIGN PATENT DOCUMENTS

EP 1 950 347 A2 7/2008

* cited by examiner

*Primary Examiner* — S. Joseph Morano
*Assistant Examiner* — Zachary Kuhfuss
(74) *Attorney, Agent, or Firm* — The Webb Law Firm

(57) ABSTRACT

The invention provides a base plate, and a fastener equipped with such a base plate, whose weight is minimized and whose stiffness is optimised on the one hand and which is suitable for being supported on an elastic intermediate layer on the other hand. To this end, a base plate according to the invention for fastening a rail to a fixed bottom support has, the base plate being made of a plastics material and a stiffening structure which is formed by ribs and by depressions present between the ribs being formed or molded in the underside of the base plate, which underside is associated with the fixed bottom support, depressions of the stiffening structure being closed off, in accordance with the invention, by a filling material.

14 Claims, 6 Drawing Sheets

BASE PLATE FOR FASTENING A RAIL TO A FIXED BOTTOM SUPPORT, AND FASTENER FOR A RAIL

The invention relates to a base plate for fastening a rail to a fixed bottom support, the base plate being made of a plastics material and a stiffening structure which is formed by ribs and by depressions present between the ribs being formed or moulded in the underside of the base plate, which underside is associated with the fixed bottom support.

As well as this, the invention relates to a fastener for a rail, which fastener is produced by using a base plate of this kind.

Known in practice is a rail fastening system offered under the name "ECF" in which the rail stands on the supporting surface of a base plate made of steel. At its longitudinal sides which are aligned in the longitudinal direction of the rail which is to be fastened in place, the supporting surface is bounded by respective ribs against which the foot of the rail is guided laterally when in the fully installed state. The rib also acts as a mounting for a clamping bolt whose head seats by positive-fit in a receptacle formed or moulded in the rib and whose shank passes through the central loop of a W-shaped clamping clip in the direction pointing away from the upper side of the base plate. By means of a nut which is screwed onto the clamping bolt, the clamping clip is then braced against the base plate in such a way that a sufficiently high hold-down force is exerted on the given side of the foot of the rail by the free ends of the resilient arms of the clamping clip.

It is ensured in this case that a rail fastener formed by the ECF system has an adequate ability to yield when a railway vehicle travels over it by an elastic intermediate layer, which intermediate layer is arranged between the base plate and a carrier plate which rests on whatever is the solid support in the given case.

To enable the position of the rail to be adjusted to whatever track gauge is required in the given case, there are formed or moulded in the ECF system, in the regions of the base plate which project laterally beyond the supporting surface, respective openings for sleeves, which openings run from the upper sides of the regions to their undersides and have seated in them eccentric sleeves which are designed to form hold-down sleeves. At its end which is at the top in the installed position, the eccentric sleeve has, in this case, a projection in the form of a collar which extends round the circumferential face of the sleeve and which rests on the upper face of the base plate in the installed position. At the same time, the heightwise distance left between the underside of the projecting collar and that end of the eccentric sleeve which is at the bottom in the installed position is of a size such that the sleeve stands on the carrier plate in the fully installed state. Inserted through the opening for the eccentric sleeve in this case is a bolt which is screwed into an anchor inset into the fixed bottom support and which thus creates an axis of rotation for the sleeve. What is achieved by this design is on the one hand that the base plate is braced against the fixed bottom support with a defined hold-down force by means of the eccentric sleeve which acts as a hold-down device. On the other hand, the position of the base plate, and with it the rail standing on it, can be shifted in a direction at right angles to the longitudinal extent of the rail by turning the eccentric sleeve, in order to adjust the position of the rail to the track gauge required.

It is a disadvantage of the known ECF system for fastening a rail in place that the base plate is high in weight and also limits the freedom which exists when designing and configuring it because of the steel material which is used to produce it.

To avoid the disadvantages of base plates of the kind explained above made of steel, a base plate of the kind specified in the opening paragraph has been proposed in EP 1 950 347 A2. This known base plate has, on its underside which is associated with the fixed bottom support, a stiffening structure which is formed by intersecting ribs which between them define respective unfilled recesses. In addition, there are formed or moulded in the base plate through-openings through which a bolt of conventional hexagon-head form can be inserted from the underside of the base plate to act as a clamping bolt to brace a clamping clip against the base plate. For the head of the clamping bolt, there is provided in this case a receptacle which is formed or moulded in the underside of the base plate and which is likewise of a hexagonal form and in which the head of the bolt is seated with positive-fit in the fully installed state.

The base plate known from EP 1 950 347 A2, which is composed of plastics material, is intended to be laid down directly on whatever is the fixed bottom support in the given case. To enable a sufficiently firm hold to be obtained, the known base plate is provided at each of its narrow sides with three through-openings through each of which a fastening bolt which can be screwed into the solid bottom support is inserted. No provision is made in this case either for any adjustment of the track gauge or for the rail to be elastically mounted.

Against the background of the prior art described above, the object of the invention was to design a base plate whose weight was minimised and whose stiffness was optimised on the one hand and which was suitable for being supported on an elastic intermediate layer on the other hand. As well as this, the intention was to provide a fastener which was optimised with regard to the ease with which it could be installed, and the fastener having optimised properties when in use.

With regard to the base plate, the invention has achieved this object by designing the base plate in the manner defined in claim 1. Advantageous embodiments of a base plate according to the invention are specified in the claims which are referred back to claim 1 and they will be explained in detail in what follows.

With regard to the fastener, this object has been achieved in accordance with the invention by the fastener which is specified in claim 12. Advantageous embodiments of a fastener according to the invention are specified in the claims which are referred back to claim 12 and they will likewise be explained in detail in what follows.

In a base plate according to the invention produced from a plastics material for fastening a rail to a fixed bottom support, at least some, and preferably all, of the depressions of the stiffening structure which is formed or moulded in the underside of the base plate are closed off with a filling material. By filling the depression, the risk is avoided, when a base plate of this kind is installed on an elastic layer, of the stiffening structure impressing itself into the elastic intermediate layer under load and doing lasting damage to the latter. What is meant by "closed off" in this connection is filling of the depressions in any way which ensures that, when the system is fully installed, the ribs on the base plate at most impress themselves into the elastic intermediate layer only by an amount sufficiently small for no permanent damage to be done in the case where a load is applied by a railway vehicle travelling over the fastening point formed by the system.

Depending on the sensitivity and load-bearing capacity of the elastic layer on which the base plate is to be placed, it may be useful for only some of the depressions to be filled with filling material. In this way, a procedure which suggests itself is, in cases where the depressions are regularly arranged, for one or more depressions to be left unfilled between two that are filled, provided that, under load, this does not cause a preset permitted load per unit area to be exceeded which is preset to ensure permanent elastic behaviour by the elastic intermediate layer. However, production becomes particularly simple and operation particularly safe and reliable if all the depressions of the stiffening structure on a base plate according to the invention are filled with moulding material.

Depending on the load-bearing capacity of the filling material, it may be enough in this case if, in the form of a thin layer, it merely closes off the given depression like a sort of lid at the opening thereof which is associated with the underside. When this is the case the filling material may for example be a sufficiently thick film or foil or plate or sheet which closes off the opening of the given depression.

If however the depressions are to be filled in such a way that particular loads can be carried or if the filling material is, in addition, to assist in sound damping or to perform some other additional function, it may be equally useful for the depressions to be completely filled with the filling material or for sufficient filling material to be placed in each of the depressions for the filling material to project above the ribs which define the given depression. Precisely in the latter case, this gives a particularly reliable guarantee that in practical operation no damage will be done to the elastic intermediate layer by the ribs.

The filling in the form of the filling material can always be introduced into the given depression in a separate stage of operations, such for example as after the production of the base plate. For this purpose, the filling material may be injected into the depressions in a flowable state or may be inserted as a pre-manufactured shaped member.

What may be considered as a plastics material for the production of the base plate is for example glass-fibre reinforced polyamide. What is suitable as a filling material on the other hand is unreinforced polyamide.

For the lateral guidance of the rail, a supporting surface for the rail which is to be fastened in place may also be formed in a known manner on the upper side of a base plate according to the invention, which supporting surface is bounded by respective supporting shoulders at its longitudinal sides which are aligned in the longitudinal direction of the rail which is to be fastened in place. Respective clamping members for bracing a resilient member intended to hold down the rail to be fastened in place may then be able to be fastened to the supporting shoulders. For this purpose, a through-opening which runs from the upper side of the base plate to its underside may be formed or moulded in the given supporting shoulder in a manner which is once again known. In order on the one hand to easily ensure in this case that the fastening bolt is securely held during the operation of bracing the resilient member and on the other hand to prevent the elastic intermediate layer from being loaded by a bolt head which projects from the underside of the base plate, a receptacle may also be formed or moulded in the underside of a base plate formed in accordance with the invention in the region of the mouth of the through-opening, in which receptacle the polygonal, and in particular hexagonal, head of the clamping bolt is seated in the fully installed state.

So that the clamping bolt whose head is seated in the receptacle is able to withstand even the high torques which may be generated when the given resilient member is being braced without separate metal members or the like having to be inserted for this purpose in the base plate which is made of plastics material, the invention proposes, in a further embodiment which is important from the practical point of view, that each side-face of the bolt head have associated with it a face for contact which is formed on the circumferential wall of the receptacle. This face for contact extends in this case for part of the length of whichever is the associated side-face of the bolt head, thus enabling the relevant side-faces of the bolt head each to have, in the installed state, planar support from the faces for contact respectively associated with them.

At the same time, the faces for contact on the circumferential wall are arranged, in this embodiment of the invention, to be spaced apart from one another, thus enabling there to be formed or moulded in the circumferential wall of the receptacle, between each pair of adjacent faces for contact, a recess in the region of which there is no contact between the bolt head and the circumferential wall of the receptacle in the fully installed state. What is achieved by a design of this kind for the receptacle is that even under a torque load there is, between the sections of the receptacle which receive the load, planar contact by which the forces to be received are transmitted into the sections of the base plate surrounding the receptacle over a comparably large area.

What are prevented in this way are the load peaks which occur in receptacles of conventional design whose shape is a close match to the shape of the bolt head which they are to receive. Because of the inevitable clearance with which the bolt head is seated in its associated receptacle, what regularly arises in this case at the edges situated between the side-faces of the bolt head is a narrow, linear region of contact at which the entire load is concentrated. This concentration of force may become so high that the bolt head works its way into the material surrounding the receptacle and there is no longer any guarantee of the bolt head being securely held. With the planar support for the side-faces of the bolt head which is achieved in accordance with the invention, this danger no longer exists.

Further minimising of the weight of the base plate can be achieved by giving the base plate, when seen in plan, a constriction in the region of the supporting surface. In this embodiment, when measured in the longitudinal direction of the rail, the width of the base plate is greater in the portions thereof which project beyond the rail laterally in the installed position than in the region which is situated underneath the foot of the rail. In this way, not only is extra weight saved but the wider lateral portions also contribute to providing optimised support for the rail against the transverse forces which act when travel takes place over it.

Excessive compression of the elastic intermediate layer when under load may also be prevented by forming on the underside of the base plate, at the underside thereof, at least one projection which points away from the underside and which acts as a stop and by which, when the system is fully installed, a limit is set for the travel by which the base plate sinks, as a result of the elasticity of the elastic intermediate layer, when a railway vehicle travels over the rail. The projection concerned may extend round the base plate in this case after the fashion of an apron which projects towards whatever is the fixed bottom support in the given case, thus ensuring that there is on all sides a stop for the sinking movement of the base plate regardless of the movement which it makes in the given case. A surrounding projection of this kind has the additional advantage that it protects the elastic intermediate layer against fouling and moisture. However, it is of course equally conceivable as an alternative for a separate projection to be provided for the same purpose at each of given points.

Formed or moulded in the base plate there may be at least one opening for a hold-down sleeve, which opening runs from the upper side of the base plate to its underside and in which opening a hold-down sleeve is put in a sliding fit, the height of which hold-down sleeve is greater than the thickness of the base plate in the region of the opening for a sleeve associated with it and which hold-down sleeve has a projection protruding from its circumferential surface which bears against the upper side of the base plate in the fully installed state, the fastening member then being intended in this case to be inserted through the opening of the hold-down sleeve. What the hold-down sleeve inserted in the opening for the sleeve does in this embodiment, in a way comparable to the prior art explained above, is to cause the base plate to be loaded only by a preset maximum force. This is a safe and certain way of preventing the base plate made of plastics material from being damaged by errors at the time of installation. At the same time, the sleeve also ensures that the elastic intermediate layer is only compressed by the fastening member so far as is required to give it a secure and reliable grip. In this way, the elasticity which the elastic intermediate layer is required to provide is reliably available even in the fully installed state. The sliding fit which the sleeve has in its associated opening in the base plate ensures in this case that the base plate is able to follow unhindered any compression or expansion of the intermediate layer which occurs as a result of the loads applied when travel takes place over it.

Formed or moulded in the base plate there may be at least one opening for a hold-down sleeve, which opening runs from the upper side of the base plate to its underside and in which opening can be inserted, as a sliding fit, a hold-down sleeve which has a projection protruding from its circumferential surface which bears against the upper side of the base plate in the fully installed state.

Basically, a base plate according to the invention is suitable for an adjustment of track gauge performed with the help of an eccentric sleeve. To enable use also to be made of this opportunity with a base plate according to the invention, the hold-down sleeve may take the form of an eccentric sleeve. In order in this case to enable a check to be made on the adjustment which is effected in the given case, which check is particularly simple and is adapted to the rough conditions which may arise on the given site, there may be formed, in the opening for the sleeve, markers for indexing which are arranged at a spacing from one another such that, allowing for the eccentricity of the axis of rotation of the eccentric sleeve from the central longitudinal axis of the opening for the sleeve, the markers for indexing define positions in rotation of the eccentric sleeve if the eccentric sleeve is adjusted in rotation about its axis of rotation in the opening for the sleeve, which positions in rotation correspond to a step-by-step change in the position of the base plate by a defined amount. Because the hold-down sleeve has at the same time a shaped member compatible with the markers for indexing in the opening for the sleeve by means of which shaped member the hold-down sleeve inserted in the opening for a sleeve associated with the said hold-down sleeve is coupled by positive-fit to a given one of the markers for indexing in the opening for the sleeve, the position of the base plate can be adjusted without any problems in a way which is easy to follow for the installer in such a way that an adjustment of the track gauge to an ideally correct size is obtained without any burdensome measurements.

In a fastener according to the invention for fastening a rail to a fixed bottom support, a base plate formed in accordance with the invention rests on an intermediate layer of an elastic material which is arranged between the base plate and the fixed bottom support.

In the event of markers for indexing being formed in a manner according to the invention in the opening for a sleeve, the fixing in place of the hold-down sleeve can be accomplished in a particularly easy way by giving the hold-down sleeve a shaped member which corresponds to the markers for indexing in the opening for a sleeve and by means of which shaped member the hold-down sleeve which is inserted in the opening for a sleeve associated with the said hold-down sleeve is coupled to a given one of the markers for indexing in the opening for the sleeve.

On the one hand to ensure that the support which the rail has on the fixed bottom support is as even as possible, but on the other hand to also minimise the abrasive wear on the elastic intermediate layer, there is provided in addition in a fastening system according to the invention a carrier plate which is to be arranged between the intermediate layer and the fixed bottom support. This can if required be made of comparably thin steel sheet or plate or of a sufficiently strong plastics material.

The carrier plate may have in this case, on its upper side adjacent the base plate, a projection which, like the projection on the base plate which points towards the fixed bottom support and which has already been described above, performs the function of a stop for the movement of the base plate when a railway vehicle travels over the rail. At the same time, the projection on the carrier plate may, if suitably configured, form a receptacle for the elastic intermediate layer. This is particularly true if the projection concerned extends along the edge of the intermediate layer for at least a sufficient proportion of the circumference of the latter or if an adequate number of separate projections which fix the position of the intermediate layer are arranged on the carrier plate.

The installation of a fastener according to the invention can be simplified by providing at least one clip which, for installation, holds together in a pre-assembled position a pack made up of the base plate, the intermediate layer situated below it and the carrier plate situated below the intermediate layer.

The invention will be explained in detail below by reference to drawings, which show an embodiment. In the drawings.

Figure 1:
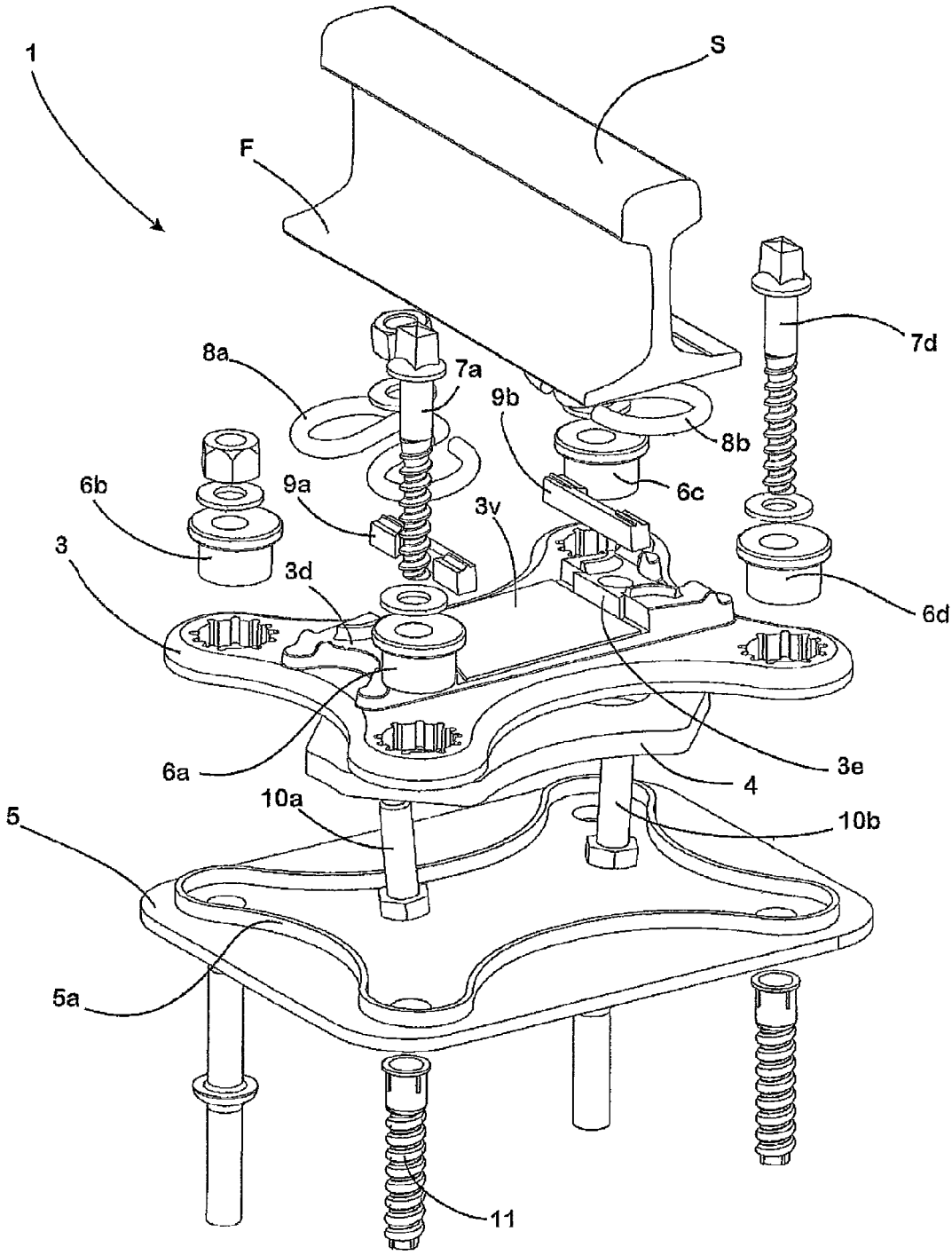
FIG. 1 is an exploded view of a system for fastening a rail in place.
Figure 2:
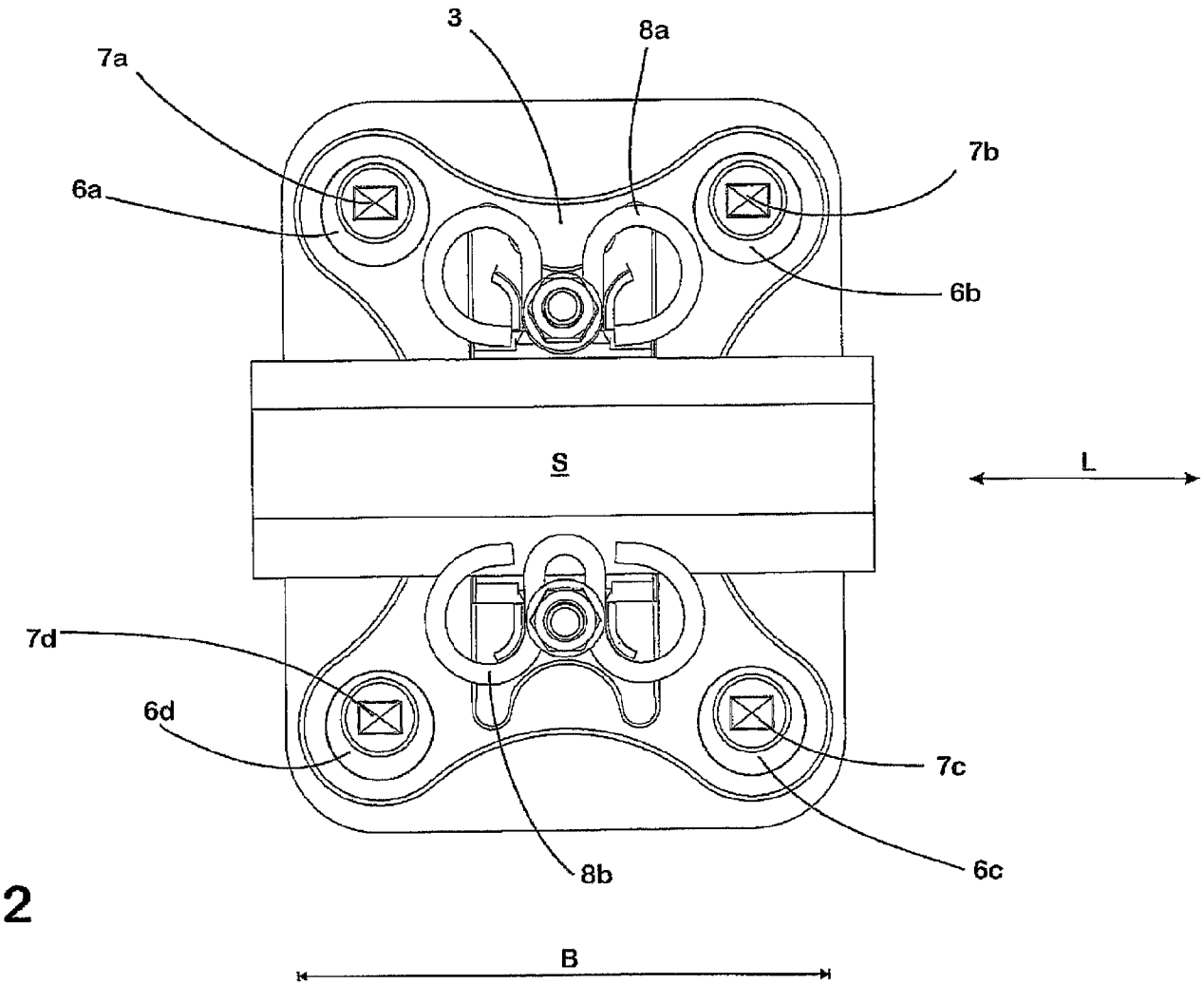
FIG. 2 is a plan view of the system in the fully installed position.
Figure 3:
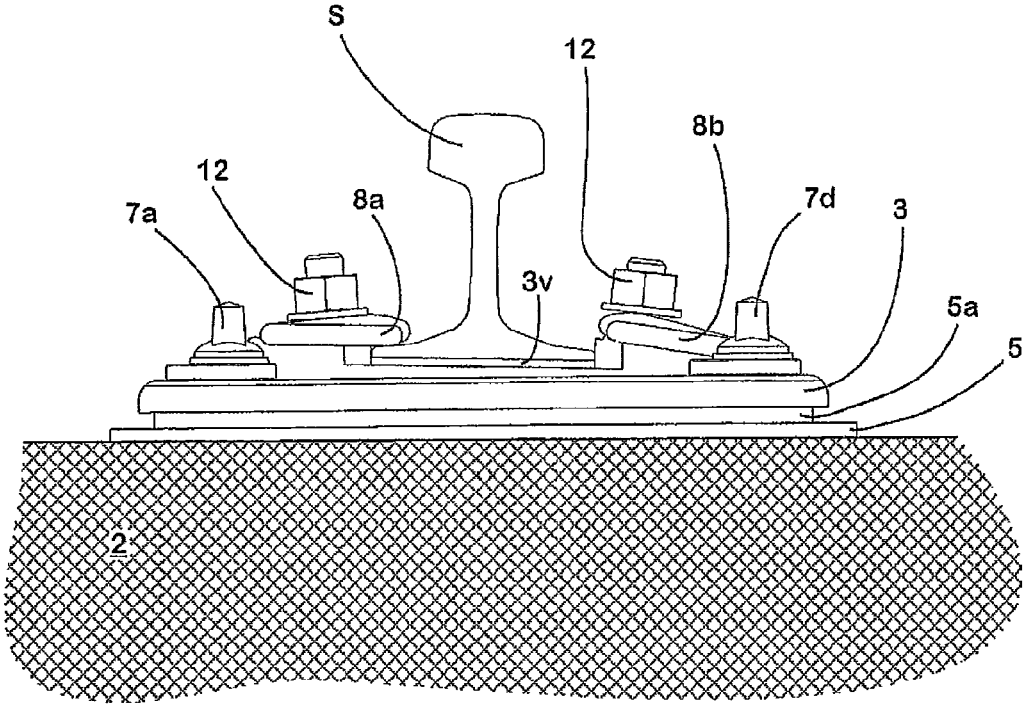
FIG. 3 is a view of the system from one side, in the fully installed position, looking in the longitudinal direction of the rail.
Figure 4:
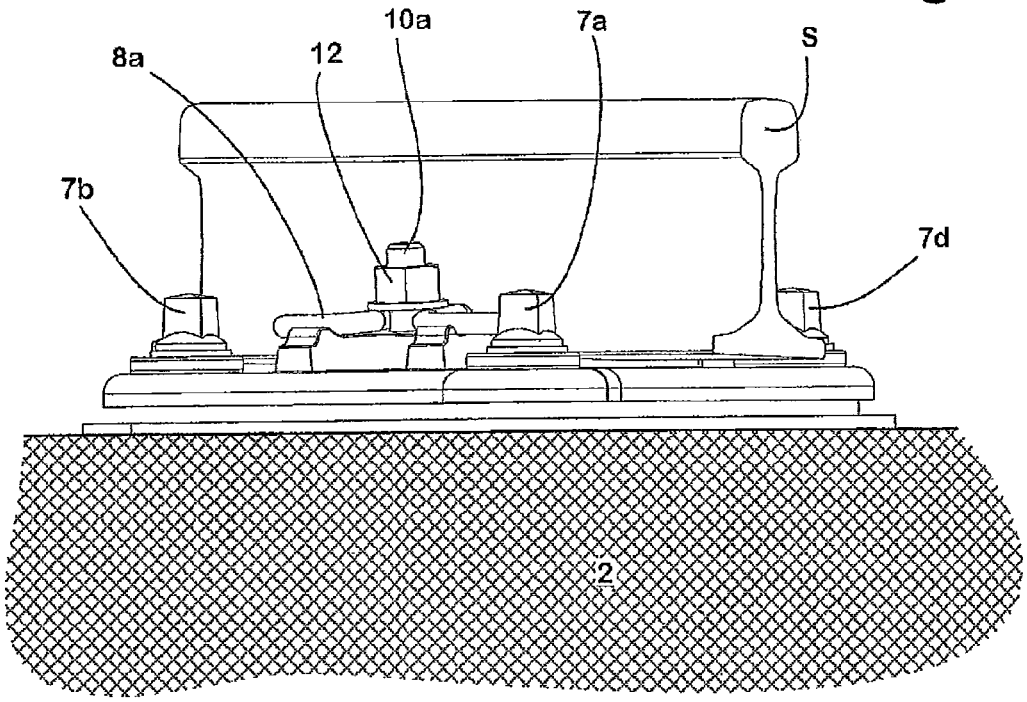
FIG. 4 is a perspective view of the system from one side in the fully installed position.

The system 1 for fastening a rail S to a fixed bottom support 2 which is formed in the present case by a concrete sleeper (not shown) comprises a base plate 3 made of a plastics material, an intermediate layer 4 made of an elastically yielding material which is to be arranged below the base plate 3, a carrier plate 5 which is to be arranged, below the intermediate layer 4, on the fixed bottom support 2, four eccentric sleeves 6*a*, 6*b*, 6*c*, 6*d* which have associated with them respective fastening bolts 7*a*, 7*b*, 7*c*, 7*d* which act as fastening members, two resilient members 8*a*, 8*b*, two adapter pieces 9*a*, 9*b*, and two clamping bolts 10*a*, 10*b*.

Figure 5:
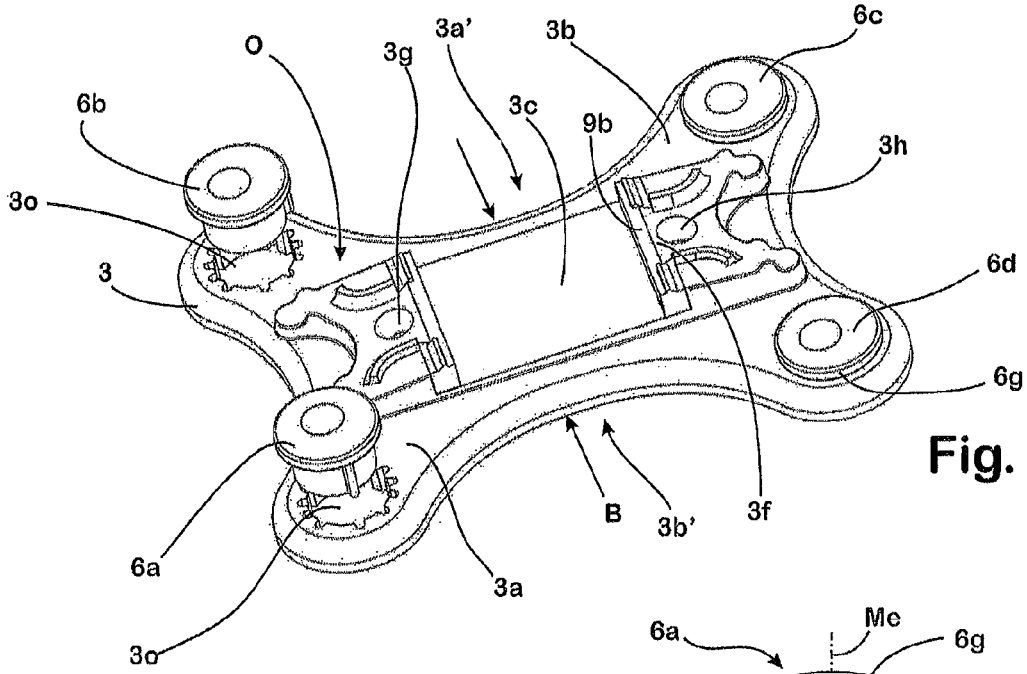
FIG. 5 is a perspective view from above of a base plate and associated eccentric sleeves.
Figure 7:
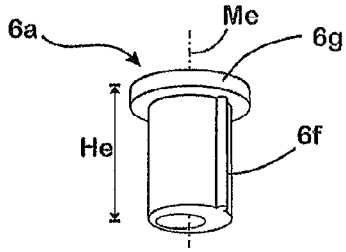
FIG. 7 is a perspective view of an eccentric sleeve.
Figure 6:
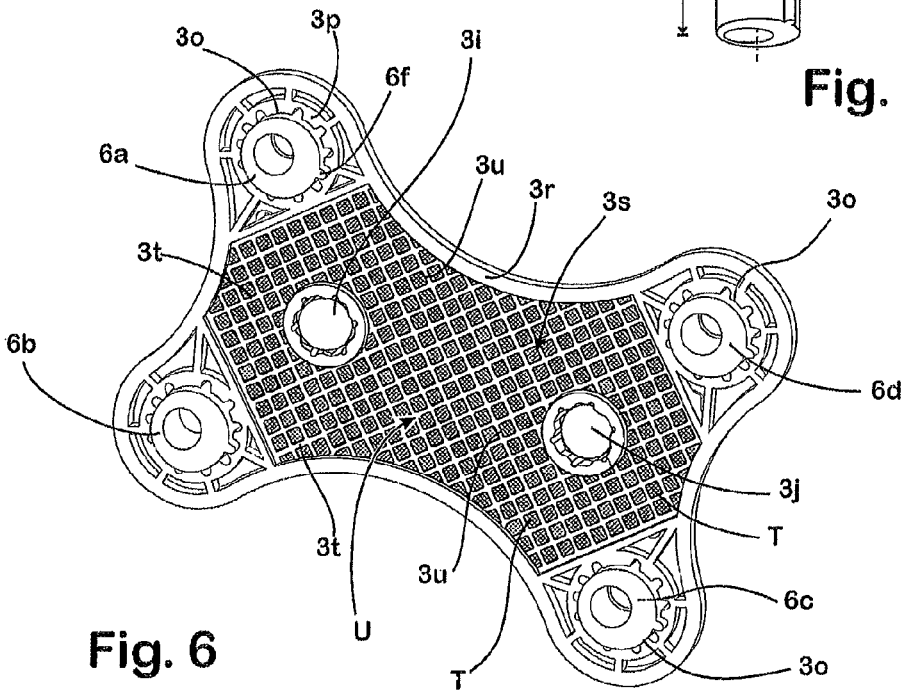
FIG. 6 is a perspective view from below of the base plate having eccentric sleeves inserted in it.

Seen in plan, the base plate 3 made of plastics material is of an elongated bone-like shape. Its outer regions 3*a*, 3*b* which adjoin respective ones of its narrow sides are of a considerably greater width B in this case, measured in the direction of the longitudinal extent L of the rail S which is to be fastened in place, than its central region, the change in the width B from the narrower central region to the adjoining wide lateral regions 3*a*, 3*b* taking place along a continuous step-free path so that constrictions 3*a*', 3*b*' are formed in the region of the supporting surface 3*c* (FIG. 5).

In the central region, there is formed or moulded on the upper side O of the base plate 3 a supporting surface 3*c* which extends in the longitudinal direction L, which extends across whatever is the width B of the narrower central region of the base plate 3 in the given case, and which is bounded laterally relative to the narrow sides of the base plate 3 by respective shoulders 3*d*, 3*e*.

A dovetail-like projection 3*f* which projects towards the shoulder 3*d*, 3*e* situated opposite is formed on each of the faces for contact of the shoulders 3*e*, 3*d*, which faces for contact are associated with the supporting surface 3*c*. By a recess of complementary shape, respective ones of the adapter pieces 9*a*, 9*b* may be fitted onto this projection 3*f* in order, if required, to bridge a gap between the latter and the foot F of the rail S which is placed on the supporting surface 3*c* and in this way to ensure secure and reliable lateral guidance for the rail S.

Formed or moulded in the shoulders 3*d*, 3*e*, in a position which is closely adjacent to the supporting surface 3*c* and central relative to the extent of the shoulders in the longitudinal direction L, are respective through-openings 3*g*, 3*h* which run from the upper side O of the base plate 3 to its underside U. Inserted through the through-openings 3*g*, 3*h* from the underside U of the base plate 3 are respective clamping bolts 10*a*, 10*b* which are configured after the fashion of a conventional hexagon-head bolt. The heads 10*c* of the clamping bolts 10*a*, 10*b* are seated in this case in respective receptacles 3*i*, 3*j* which are formed or moulded in the underside U of the base plate 3 and which are arranged in the region of the mouths of respective ones of the through-openings 3*g*, 3*h*.

The receptacles 3*i*, 3*j* are each surrounded by a circumferential wall 3*k* which is integrally connected to the base plate 3. In their respective circumferential surfaces associated with the receptacles 3*i*, 3*j*, there are formed on the circumferential walls 3*k* six faces for contact 3*l* which are distributed at equal angular intervals around the centres of the respective receptacles 3*i*, 3*j* and the length La of each of which, measured in the circumferential direction of the respective receptacles 3*i*, 3*j*, is less than half the length Ls of the side-faces 10*d* of the bolt head 10*c*. Formed or moulded in the given circumferential wall 3*k* between each pair of adjacent faces for contact 3*l* is a recess 3*m* which recedes into the circumferential wall 3*k* relative to the faces for contact 3*l*. In the circumferential wall 3*k*, there is formed or moulded in addition in this case, adjacent to one of the faces for contact 3*l* which define each of the recesses 3*m*, a load-relieving recess 3*n* formed after the fashion of a groove, while the recess 3*m* merges into the other face for contact which defines it at a relatively shallow angle.

Figure 8:
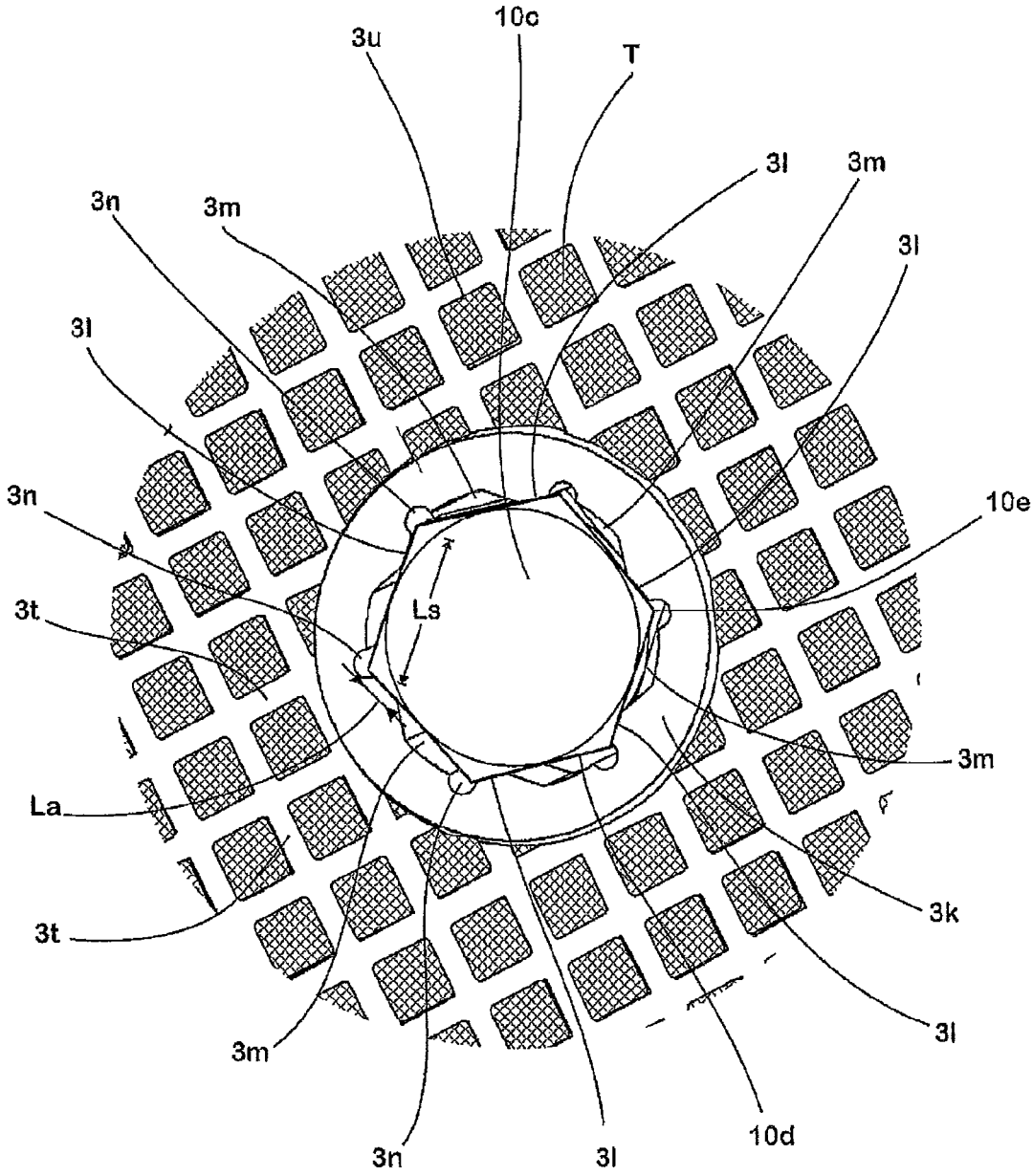
FIG. 8 is a perspective view from below showing a first enlarged detail of the base plate.
Figure 9:
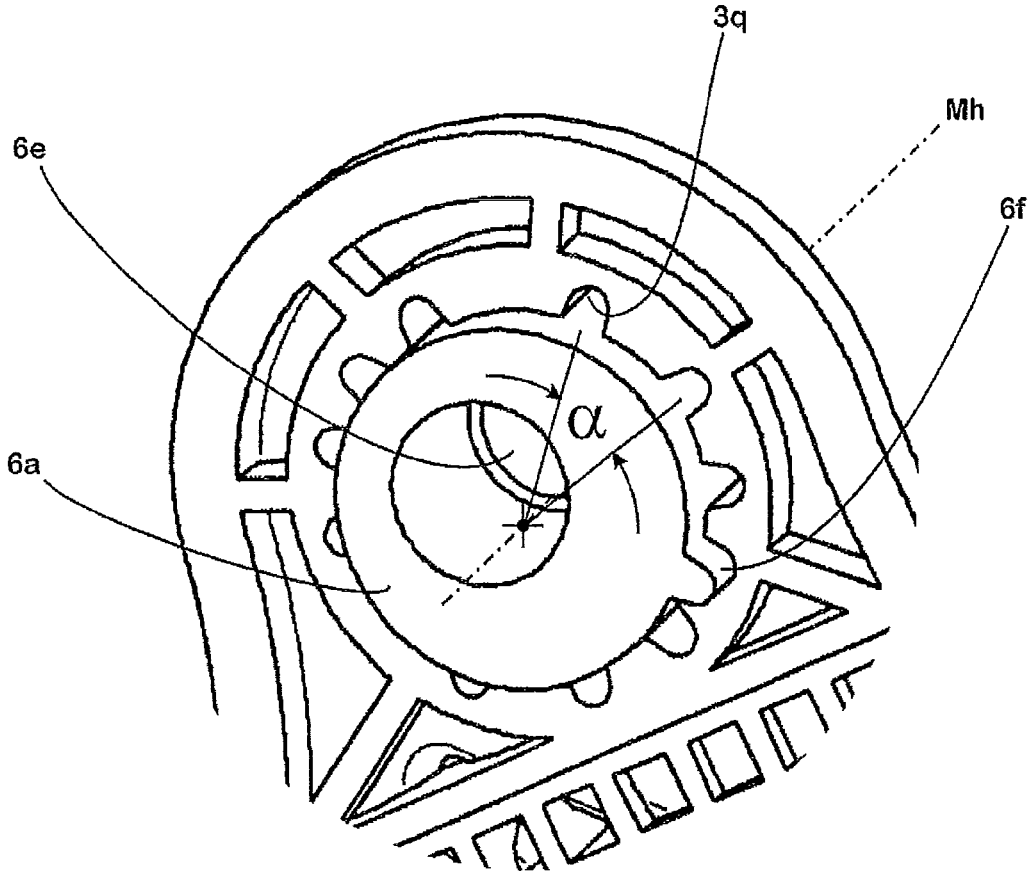
FIG. 9 is a perspective view from below showing a second enlarged detail of the base plate.

The regular distribution of the faces for contact 3*l*, recesses 3*m* and load-relieving recesses 3*n* belonging to the respective receptacles 3*i*, 3*j*, and their position and dimensions, are selected in such a way that, in the fully installed position (FIG. 8), the side-faces 10*d* of the bolt head 10*c* bear against respective ones of the faces for contact 3*l* and each of the edges 10*e* of the bolt head 10*c* which are present between pairs of side-faces 10*d* is arranged in the region of a load-relieving recess 3*n* without being in contact with the given circumferential wall 3*k*.

In the same way, in the region of the recesses 3*m* there is no contact between the bolt head 10*c* and the given circumferential wall 3*k*, which means that it is only the faces for contact 3*l* which receive the torques acting on the bolt head 10*c* during installation and in practical operation. The bolt head 10*c* is prevented from cutting into the material of the circumferential wall 3*k* in the region of its edges 10*e* in this way, and any damage to or destruction of the circumferential wall as a result of overloading is also prevented.

The base plate 3 is therefore able to withstand without any problems the torques which arise when the resilient members 8*a*, 8*b*, which take the form of a conventional ω-shaped clamping clip, are being braced. For the resilient members 8*a*, 8*b* to be braced, they are placed on the base plate 3 in such a way that the threaded shanks of the clamping bolts 10*a*, 10*b* respectively associated with them pass through the centre loops of the resilient members 8*a* and 8*b* respectively and the free resilient arms of the resilient members 8*a*, 8*b* rest on the foot F of the rail. Then, by means of nuts 12 which are screwed onto the respective threaded shanks, the centre loops of the resilient members 8*a*, 8*b* are pressed towards the base plate 3 until an adequate hold-down force is exerted on the foot F of the rail.

In the region of each of its corners, there is formed or moulded in the base plate 3 an opening 3*o* for a sleeve which runs from the upper side O of the base plate 3 to its underside U.

Seated in each of the four openings 3*o* for sleeves is one of the eccentric sleeves 6*a*-6*d* which are produced from a sufficiently strong material which is able to slide well when paired with the material of the base plate 3. These eccentric sleeves 6*a*-6*d* have a through-opening 6*e* which is eccentrically arranged relative to the centre axis Me of the given eccentric sleeve 6*a*-6*d*. Formed on the outer circumferential surface of each of the eccentric sleeves 6*a*-6*d* is a narrow indexable projection 6*f* whose axis extends parallel to the centre axis Me and which extends for the full height He of each of the eccentric sleeves 6*a*-6*d*. The eccentric sleeves 6*a*-6*d* are designed in this case to act as hold-down sleeves, for which purpose they have, at their upper edge associated with the upper side O of the base plate 3, a projection 6*g* which extends round in a circle after the fashion of a collar. In the fully installed state, the projection 6*g* from the eccentric sleeves 6*a*-6*d* bears against the upper side O of the base plate 3.

The four openings 3*o* for sleeves are each surrounded by a circumferential wall 3*p* which is formed by the plastics material of the base plate 3. Formed or moulded in the circumferential wall 3*p* at irregular angular intervals α are markers for indexing 3*q* which take the form of grooves, and whose axes extend parallel to the centre axis Mh of the given opening 3*o* for a sleeve, and whose shape is complementary to that of the indexable projection 6*f* which is formed on each of the eccentric sleeves 6*a*-6*d*.

The markers for indexing 3*q* and the openings 3*o* for sleeves are each so designed in this case that the eccentric sleeves 6*a*-6*d* respectively associated with them are guided in them by their indexable projections 6*f* as a sliding fit and with positive-fit, in such a way that the position in rotation of the eccentric sleeves 6*a*-6*d* in the openings 3*o* for sleeves associated with them is fixed but at the same time a relative movement between the base plate 3 and the given sleeve 6*a*-6*d* directed in the direction defined by the centre axis Me is possible without any problems.

When the system 1 is being installed, one of the fastening bolts 7*a*-7*d* is inserted through the through-opening 6*e* in each of the eccentric sleeves 6*a*-6*d* and is screwed into the anchor 11 of plastics material which is inset into the fixed bottom support 2. In this way, the fastening bolts 7*a*-7*d* each create an axis of rotation about which the eccentric sleeve 6*a*-6*d* associated with them can be adjusted in rotation. Taking into account the eccentricity of the axis of rotation which is created in this way relative to the centre axis Mh of the given opening 3*o* for a sleeve, the angular intervals α between the markers for indexing 3*q* are of a size such that, when the base plate 3 is fully installed, each adjustment in rotation between two markers for indexing involves a displacement of the base plate 3 in a direction at right angles to the longitudinal extent of the rail S by a distance which is always of the same size. In this way, the angular intervals α may for example be so designed that each adjustment in rotation of the eccentric sleeves 6*a*-6*d* displaces the base plate 2 by one millimeter to allow the track gauge to be adjusted.

Integrally formed or moulded on the base plate 3, to extend round the edge of the base plate 3, is an apron-like projection 3*r* which points away from the underside U. The projection 3*r* acts as a stop for movements directed towards the fixed bottom support 2 which the base plate 3 makes when a railway vehicle (not shown) travels along the rail S standing on it.

Formed or moulded into the base plate 3, in that region of the underside U which is not occupied by the openings 3*o* for sleeves and their circumferential walls 3*q* or by the receptacles 3*i*, 3*j*, is a stiffening structure 3*s* which is formed by ribs 3*t* which intersect at right angles and by depressions 3*u* which are arranged between them. The depressions 3*u* are filled in this case with a moulding material T which is lightweight but dimensionally stable. The filling T of moulding material terminates in this case substantially flush with the free top of the ribs 3*t* or projects beyond the top of the ribs for a distance of, typically, at least 2 mm, and there are thus no longer any sharp protruding edges of the ribs 3*t*.

So that the rail S is also supported elastically directly against the base plate 3, an elastic layer 3*v* which is composed of a permanently elastic plastics material is sprayed onto the supporting surface 3*c*. Alternatively, it is also possible for the elastic layer 3*v* to be formed by a pre-manufactured pad of elastic material which is placed down on the supporting surface 3*c* and which is in particular adhesively bonded thereto.

When seen in plan, the elastic intermediate layer 4 is of a shape which corresponds to the area occupied by the stiffening structure 3. When the system 1 is in the fully installed state, the stiffening structure 3 therefore completely covers the intermediate layer 4. This being so, even under the load applied by a railway vehicle travelling along the rail S, the filling T of filling material which is present in the depressions 3*u* of the stiffening structure 3*s* ensures that the ribs 3*t* of the stiffening structure 3*s* do not cut into the intermediate layer 4. Instead, the base plate 3 is always supported on the elastic intermediate layer 4 over such a large area that an optimum resilient action is maintained in the long term.

The thin carrier plate 5 which rests on the fixed bottom support 2 serves to protect the elastic intermediate layer against abrasive wear and dirt and ensures that there is an even surface for it to rest on. To secure the elastic intermediate layer in place on the carrier plate 5, a projection 5*a* which follows the outline shape of the elastic layer forms, on the upper side of the carrier plate 5, which upper side is associated with the base plate 3, a receptacle in which, when the system 1 is fully installed, the intermediate layer 4 is seated in positive-fit. In addition, the projection 5*a* also acts in this case as a stop which sets a limit to the movements of the base plate 3 directed towards the fixed bottom support 2 and which prevents any excessive compression of the elastic intermediate layer 4.

The elastic intermediate layer 4 is also protected against being too highly compressed when being installed by the fact that the height He of the eccentric sleeves 6*a*-6*d*, which are designed to act as hold-down sleeves and which stand on the carrier plate 5 in the fully installed state, is selected to be such that the base plate 3 is only pressed against the elastic intermediate layer 4 with a defined force even when the fastening bolts 7*a*-7*d* are fully tightened. If the force concerned is to be very low, the height He of an eccentric sleeve is selected to be one which corresponds to the thickness of the base plate 3 in the region of the openings 3*o* for sleeves plus the thickness of the elastic layer in the relaxed installed state, less the thickness of the projection 6*g*.

REFERENCE NUMERALS

α Angular intervals
1 System for fastening a rail S in place
2 Bottom support
3 Base plate
3*a*, 3*b* Outer regions of the base plate 3
3*c* Supporting surface of the base plate 3
3*d*, 3*e* Shoulders of the base plate 3
3*f* Projection
3*g*, 3*h* Through-openings
3*i*, 3*j* Receptacles in the base plate 3
3*k* Circumferential wall
3*l* Face for contact
3*m* Recess
3*n* Load-relieving recess
3*o* Opening for sleeve
3*p* Circumferential wall
3*q* Marker for indexing
3*r* Projection
3*s* Stiffening structure
3*t* Rib
3*u* Depression
3*v* Elastic layer
4 Elastic intermediate layer
5 Carrier plate
5*a* Projection
6*a*-6*d* Eccentric sleeves
6*e* Opening in sleeve
6*f* Indexable projection
6*g* Projection
7*a*-7*d* Fastening bolts
8*a*, 8*b* Resilient members
9*a*, 9*b* Adapter pieces
10*a*, 10*b* Clamping bolts
10*c* Bolt head
10*d* Side-face of bolt head 10*c*
10*e* Edge of bolt head 10*c*
11 Anchor of plastics material
12 Nut
B Width of the base plate 3 at respective points
F Foot of rail
He Height
L Longitudinal direction
La, Ls Lengths
Me Centre axis of a given eccentric sleeve 6*a*-6*d*
Mh Centre axis of a given opening 3*o* for a sleeve O Upper side of the base plate 3
S Rail
T Moulding material
U Underside of the base plate 3

The invention claimed is:

1. A fastener for fastening a rail to a fixed bottom support comprising a base plate and an intermediate layer of an elastic material arranged between the base plate and the fixed bottom support, wherein the base plate comprises a plastics material and a stiffening structure which is formed by ribs and by depressions present between the ribs being formed or moulded in an underside of the base plate, wherein the underside is associated with the fixed bottom support, wherein the depressions of the stiffening structure are closed off by a filling material.

2. The fastener according to claim 1, wherein the filling material completely fills the depressions of the stiffening structure.

3. The fastener according to claim 1, wherein the filling material has sound-damping properties.

4. The fastener according to claim 1, wherein there is present on an upper side of the base plate, a supporting surface for the rail which is to be fastened in place, wherein the supporting surface is bounded by respective supporting shoulders at longitudinal sides of the supporting surface which are aligned in a longitudinal direction of the rail which is to be fastened in place.

5. The fastener according to claim 4, wherein respective clamping members for bracing a resilient member can be fastened to the supporting shoulders, the resilient member intended to hold down the rail to be fastened in place.

6. The fastener according to claim 5, wherein a through-opening which runs from the upper side of the base plate to the underside of the base plate is formed or moulded in the given supporting shoulder to allow the clamping member to be fastened in place.

7. The fastener according to claim 6, wherein the clamping member is a clamping bolt having a polygonal head with side faces and, wherein a receptacle is formed or moulded in the underside of the base plate around the perimeter of the through-opening, wherein the receptacle comprises a circumferential side wall having contact faces formed thereon and associated with each side-face of the bolt head, wherein each contact face extends partially the length of an associated bolt head side-face, such that in an installed state, the contact faces provide planar support against the bolt head side-faces, wherein the contact faces of the circumferential wall are arranged to be spaced apart from one another such that recesses are formed or moulded in the circumferential wall of the receptacle, between directly adjacent contact faces, and wherein, at a first recess, there is no contact between the bolt head and the circumferential wall of the receptacle in the fully installed state.

8. The fastener according to claim 4, wherein the base plate has a constriction in the region of the supporting surface.

9. The fastener according to claim 1, wherein there is formed on the underside of the base plate at least one projection which points away from the underside and which acts as a stop.

10. The fastener according to claim 1, wherein the base plate has at least one opening, which runs from an upper side of the base plate to an underside of the base plate, for a hold-down sleeve having a circumferential surface, wherein the hold-down sleeve has a projection protruding from the circumferential surface which bears against the upper side of the base plate in a fully installed state.

11. The fastener according to claim 10, wherein the hold-down sleeve takes the form of an eccentric sleeve and, wherein there are formed, in the opening for the sleeve, markers for indexing which are arranged at a spacing from one another such that, allowing for the eccentricity of an axis of rotation of the eccentric sleeve from a central longitudinal axis of the opening for the sleeve, the markers for indexing define positions in rotation of the eccentric sleeve if the eccentric sleeve is adjusted in rotation about the axis of rotation in the opening for the sleeve, which positions in rotation correspond to a step-by-step change in the position of the base plate by a defined amount.

12. The fastener according to claim 1, wherein the base plate has at least one opening, which runs from an upper side of the base plate to an underside of the base plate, for a hold-down sleeve having a circumferential surface, which hold-down sleeve has a projection protruding from the circumferential surface which bears against the upper side of the base plate in a fully installed state, which hold-down sleeve can be inserted from the upper side of the base plate through the opening for a sleeve associated with the opening in the base plate as a sliding fit, the height of which hold-down sleeve is greater than a thickness of the base plate in a region of the opening for a sleeve associated with the opening, and which hold-down sleeve has a projection protruding from its circumferential surface which bears against the upper side of the base plate in the fully installed state, and wherein a fastening member which can be inserted through the opening of the hold-down sleeve is intended to fasten the hold-down sleeve to the fixed bottom support.

13. The fastener according to claim 12, wherein the base plate has at least one opening, which runs from an upper side of the base plate to an underside of the base plate, for a hold-down sleeve having a circumferential surface, which hold-down sleeve has a projection protruding from the circumferential surface which bears against the upper side of the base plate in a fully installed state, wherein the hold-down sleeve takes the form of an eccentric sleeve and, wherein there are formed, in the opening for the sleeve, markers for indexing which are arranged at a spacing from one another such that, allowing for the eccentricity of an axis of rotation of the eccentric sleeve from a central longitudinal axis of the opening for the sleeve, the markers for indexing define positions in rotation of the eccentric sleeve if the eccentric sleeve is adjusted in rotation about the axis of rotation in the opening for the sleeve, which positions in rotation correspond to a step-by-step change in the position of the base plate by a defined amount, and wherein the hold-down sleeve has a shaped member corresponding to the markers for indexing in the opening for the sleeve by means of which shaped member the hold-down sleeve inserted in the opening for a sleeve associated with the said hold-down sleeve is coupled by positive-fit to a given one of the markers for indexing in the opening for the sleeve.

14. The fastener according to claim 1, wherein a carrier plate is arranged between the elastic intermediate layer and the fixed bottom support.

* * * * *